US006161635A

United States Patent [19]

Brady

[11] Patent Number: 6,161,635

[45] Date of Patent: Dec. 19, 2000

[54] DRILLING SYSTEM DRIVE STEEL

[76] Inventor: William J. Brady, 1767 Wishingwell Dr., Creve Coeur, Mo. 63141

[21] Appl. No.: 09/260,159

[22] Filed: Mar. 1, 1999

Related U.S. Application Data

[63] Continuation-in-part of application No. 09/046,382, Mar. 23, 1998, Pat. No. 6,092,612, which is a continuation-in-part of application No. 08/689,667, Aug. 13, 1996, Pat. No. 5,875,858, which is a continuation-in-part of application No. 08/472,913, Jun. 7, 1995, abandoned.

[51] Int. Cl.[7] ..... E21B 4/00

[52] U.S. Cl. ..... 175/393; 175/324; 175/325.2; 299/39.9; 299/41.1; 299/55; 299/81.3

[58] Field of Search ..... 175/324, 325.1, 175/325.2, 320, 327, 393; 299/39.9, 41.1, 55, 81.1, 81.3, 100

[56] References Cited

U.S. PATENT DOCUMENTS

| | | | |
|---|---|---|---|
| 3,842,610 | 10/1974 | Willis et al. . | |
| 4,051,905 | 10/1977 | Kleine . | |
| 4,086,972 | 5/1978 | Hansen et al. . | |
| 4,387,775 | 6/1983 | Adolfsson et al. | 175/135 |
| 4,474,252 | 10/1984 | Thompson . | |
| 4,497,185 | 2/1985 | Shaw . | |
| 4,682,661 | 7/1987 | Hughes et al. . | |
| 4,863,355 | 9/1989 | Odagiri et al. . | |
| 5,004,382 | 4/1991 | Yoshino . | |
| 5,046,932 | 9/1991 | Hoffmann . | |
| 5,074,025 | 12/1991 | Willard . | |

*Primary Examiner*—Roger Schoeppel
*Attorney, Agent, or Firm*—Richard G. Heywood

[57] ABSTRACT

A drive steel member for driving engagement with a rotary drilling machine, including a chuck adapter having main body and chuck seating elements and being constructed and arranged in fixed, sealing relation on on one end of the drive steel member.

18 Claims, 6 Drawing Sheets

DRILLING SYSTEM DRIVE STEEL

This application is a continuation-in-part of my patent application Ser. No. 09/046,382 filed Mar. 23, 1998 for Rotary Drilling Systems now U.S. Pat. No. 6,092,612 issued Jul. 25, 2000, which is a continuation-in-part of my patent application Ser. No. 08/689,667 filed Aug. 13, 1996 and entitled Low Volume Air-Water Drilling Systems and Methods now U.S. Pat. No. 5,875,858 issued on Mar. 2, 1999, which is a continuation-in-part of parent patent application Ser. No. 08/472,913 filed Jun. 7, 1995 (now abandoned).

BACKGROUND OF THE INVENTION

1. Field of the Invention

The invention relates generally to rotary drilling systems, and more specifically to drive steel improvements for drilling systems as used in drilling and boring for roof bolting operations for tunnel construction, mining and the like.

2. Description of the Prior Art

In the fields of industrial, mining and construction tools, polycrystalline diamond (PCD) is now in wide use in making cutting tool inserts, sometimes called polycrystalline diamond compacts (PDC). PCD materials are formed of fine diamond powder sintered by intercrystalline bonding under high temperature/high pressure diamond synthesis technology into predetermined layers or shapes; and such PCD layers are usually permanently bonded to a substrate of "precemented" tungsten carbide to form such PDC insert or compact. The term "high density ceramic" (HDC) is sometimes used to refer to a mining tool having a PCD insert. "Chemical vapor deposition" (CVD) and "Thermally Stable Product" (TSP) diamond-forms may be used for denser inserts and other super abrasive hard surfacing and layering materials, such as layered "nitride" compositions of titanium (TiN) and carbon ($C_2N_2$)and all such "hard surface" materials well as titanium carbide and other more conventional bit materials are applicable to the present invention.

The principal types of drill bits used in rotary drilling operations are roller bits and drag bits. In roller bits, rolled cones are secured in sequences on the bit to form cutting teeth to crush and break up rock and earth material by compressive force as the bit is rotated at the bottom of the bore hole as in mining operations. In drag bits, PCD or like cutting elements on the bit act to cut or shear the earth material. The action of some flushing fluid medium, such as fluid drilling mud, water or a compressed air/vacuum system, is important in all types of drilling operations to cool the cutting elements and to flush or transport cuttings away from the cutting site. It is important to remove cuttings from the hole to prevent accumulations that may plug water passages and otherwise interfere with the crushing or cutting action of the bit; and the cooling action is particularly important in the use of PCD/CVD/TSP cutters to prevent carbon transformation of the diamond material.

Roof drill bits are one form of a rotary drag bit used in roof bolting operations, which are overhead so the drilling operation is upward through earth structures of extremely hard rock or mineral (coal) deposits; and stratas of shale, loose (fractured) rock and mud layers are frequently encountered.

My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerate the speed of drilling action and substantially reduce bit breakage and change-over downtime.

Although my prior HCD bits easily drill through these earth structures, it was discovered that some drill bits might plug in drilling through mud seams and other soft earth formations. In addition, the use of large quantities of drilling fluids for overhead irrigation resulted in uncontrolled water loss and floor flooding.

Based upon comparative tests in three states it was determined that the amount of water required to wet drills with PCD rotary bits may be reduced from a conventional (tungsten carbide bit) range of 9–18 gallons per minutes down to about 1–3 quarts per minute when atomized into an air mist on PCD inserts. My co-pending application Ser. No. 08/689,667 (U.S. Pat. No. 5,875,858) discloses a compressor and air-water mixing system that greatly reduces the amount of water required for effective hole flushing while substantially reducing the amount of respirable dust. The disclosure of this U.S. Pat. No. 5,875,858 is incorporated by reference as if set out in its entirety.

My co-pending application Ser. No. 09/046,382 discloses rotary drilling systems including improvements in drive steel columns and secondary bore reamers whereby to ensure delivery of flushing fluid and effective bit and reamer cooling without substantial pressure loss, and especially using the low volume air mist system of my earlier work. The disclosure of this co-pending application Ser. No. 09/046,382 is incorporated herein by reference as though set out in its entirety.

A continuing prior art problem not addressed by my co-pending application Ser. No. 09/046,382 involves the connection of the drive steel to the chuck of a drilling machine. The prior practice in the industry utilizes a connector on the tubular drill steel end with a flanged end to seat in the machine chuck; and these prior connectors have been fastened on the drill steel using one of the following techniques:

(1) a connector shank is forged onto the round drill steel with the potential problems of (a) being off center, (b) too high or low forging temperature, and (c) improper re-tempering; and forged drill steel is relatively expensive and labor intensive;

(2) a connector is welded onto thin walled round or hex drill steel which may break due to fatigue and failure resulting from metal softening in the welded area (has been banned in some jurisdictions due to injuries);

(3) a connector is press fit into a machined hex drill steel with the potential problems of (a) off center tapering and (b) loosening due to metal flow;

(4) hex drill steel rods are cut to length and a chuck connector is inserted into a drilled rod end with the problems of (a) drill steel softness in the range of 28–35 Rc resulting in bending and also mushrooming on the machine chuck, (b) loosening and pulling apart of the connector, and (c) not water tight for wet drilling or air tight with loss of vacuum when drilling dry.

SUMMARY OF THE INVENTION

The invention is embodied in drilling system drive steel improvements for drilling bores in earth formations using a hard surfaced rotary drill bit, comprising chuck shank adapter means for releasably connecting a drive steel column to a drilling machine and which shank adapter is nestably and fixedly secured with one end of a drive steel member.

It is an object of the present invention to provide a rotary drilling system that accommodates a low volume air/water flushing fluid and ensures delivery of flushing fluid without substantial pressure loss. Another object is to provide a novel drive steel coupling arrangement for sealably and releasably connecting to a drilling machine chuck. Still other objectives of the invention include elimination of prior connection problems of drive steel softness, loose fit and air/water leakage, disconnection of the drive steel and the like. Another major objective is to provide a safe, strong permanently shanked drill steel that is fully heat treated to 40 Rc,and which is economically and correctly fabricated. These and other objects and advantages will become more apparent hereinafter.

BRIEF DESCRIPTION OF THE DRAWINGS

In the accompanying drawings which form a part of this specification and wherein like numerals refer to like parts wherever they occur.

BRIEF DESCRIPTION OF THE PREFERRED EMBODIMENTS

The present invention pertains generally to mining operations that include roof drilling, longwall mining and continuous mining particularly in which water flushing is non-recoverable; and specifically the invention pertains to improvements in drilling drive steel columns for non-leak systems especially using low volumes of water or air flushing fluids and for maintaining better fluid flow control in a drill steel column.

Figure 1:
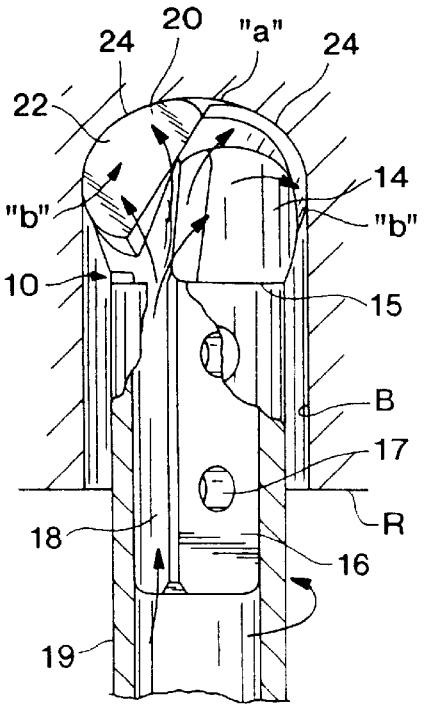
FIG. 1 is a side elevational view, partly broken away, showing one form of a rotary drill bit useful in the present invention.

FIG. 1 shows one embodiment of my earlier non-coring roof drill bit as taught by U.S. Pat. Nos. 5,180,022; 5,303,787 and 5,383,526—the disclosures of which have been incorporated by reference. Briefly stated, this non-coring roof drill bit 10 is typically seated on the end of a long rod drive steel 19 (119) of a drilling machine 76, such as a New Fletcher double boom roof bolter (shown in FIG. 6). The bit shank 16 and drive steel 19 have a complementary sliding fit and are typically cross-pinned together at bolt holes 17 or threadedly connected (see FIGS. 7 and 16) for co-rotational movement. The shank 16 has vertical flutes 18 formed on opposite sides for channeling water or air flushing fluid used for cooling and cleaning the cutter inserts 20 of the drill bit 10. This drill bit embodiment is shown drilling bore B in roof top R, and constitutes a long wearing drill bit that is especially successful in drilling through extremely hard rock formations.

Figure 2:
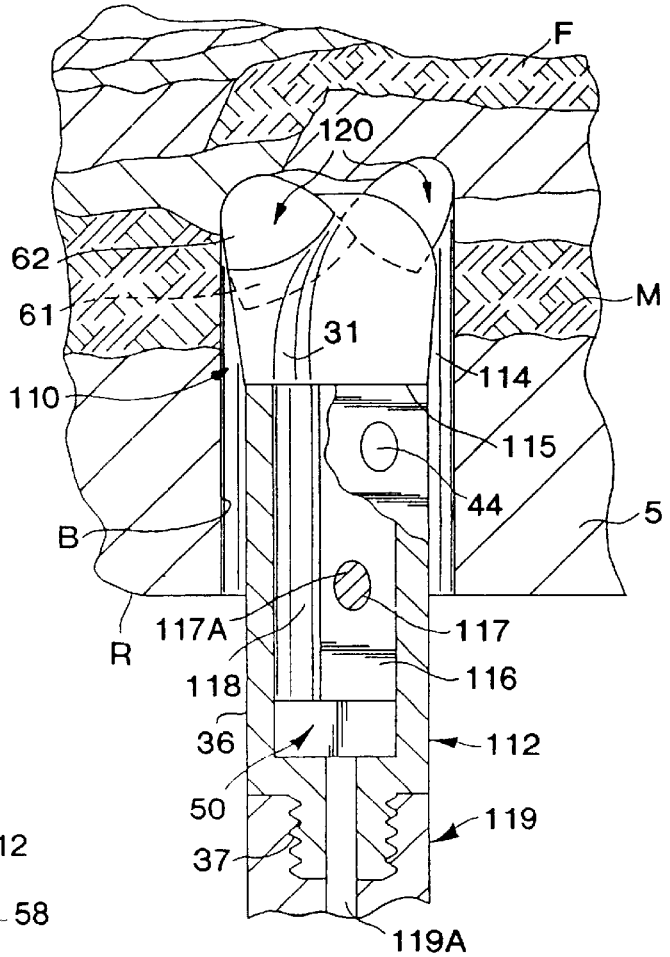
FIG. 2 is a side elevational view, partly broken away, illustrating another form of a rotary drill bit and a bit coupler.
Figure 3:
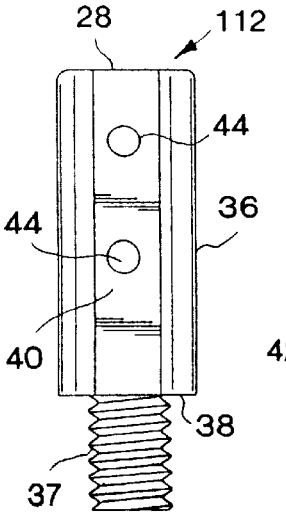
FIG. 3 is a side elevational view of the bit coupler as rotated 45° from FIG. 2.
Figure 4:
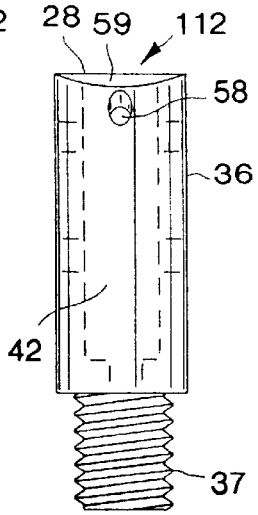
FIG. 4 is a side elevational view of the bit coupler as rotated 90° from FIG. 3.
Figure 5:
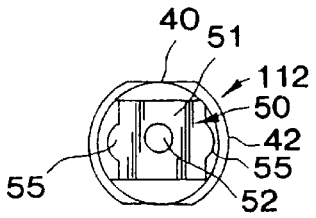
FIG. 5 is a top plan view of the bit coupler.

FIG. 2 shows one embodiment of my earlier coring roof drill bit as taught by my U.S. Pat. No. 5,535,839—the disclosure of which has been incorporated by reference. This coring-type drill bit 110 is shown connected through a bit coupler or mounting adapter 123 to a drive steel 119 and operates to drill bore B in the roof R as in a mine or tunnel. The roof top formation in FIG. 2 illustrates solid rock S, fractured rock or shale F and mud seams M. The drill bit 110 has a mounting shank 116 that is secured to the drive column of the drilling machine 76 (see FIG. 6). Although the drill bit 110 could be connected directly to the drive steel 119 (as in FIG. 1), the mounting adapter or coupler 123 of FIGS. 3–5 provides an improved coupling arrangement. The shank portion 116 of the drill bit in this embodiment is also provided with the usual vertical flutes 118 recessed inwardly on opposite sides of the shank and which serve to channel air/vacuum/liquid flushing fluid for cooling the cutter inserts 120 and cleaning away debris from the cutting area of the tool.

The bit coupler or mounting adapter 123 permits assembly and disassembly for replacing the drill bit 110 on the drive steel 119 with a minimum of unproductive downtime. An important function of the coupler 123 is to accommodate the flow of flushing fluid from the drilling machine 76 through bore 119A of the drive steel and bit flutes 118 to the cutter inserts 120. To that end the coupler 123 has a central body chamber 50 that connects a through port or bore 52 to the drive steel chamber 119A. The distribution and the vertical flow of flushing fluid upwardly through the coupler 123 is enhanced by providing vertical water flumes or canals 55 openly exposed to the shank water flutes 118.

Figure 6:
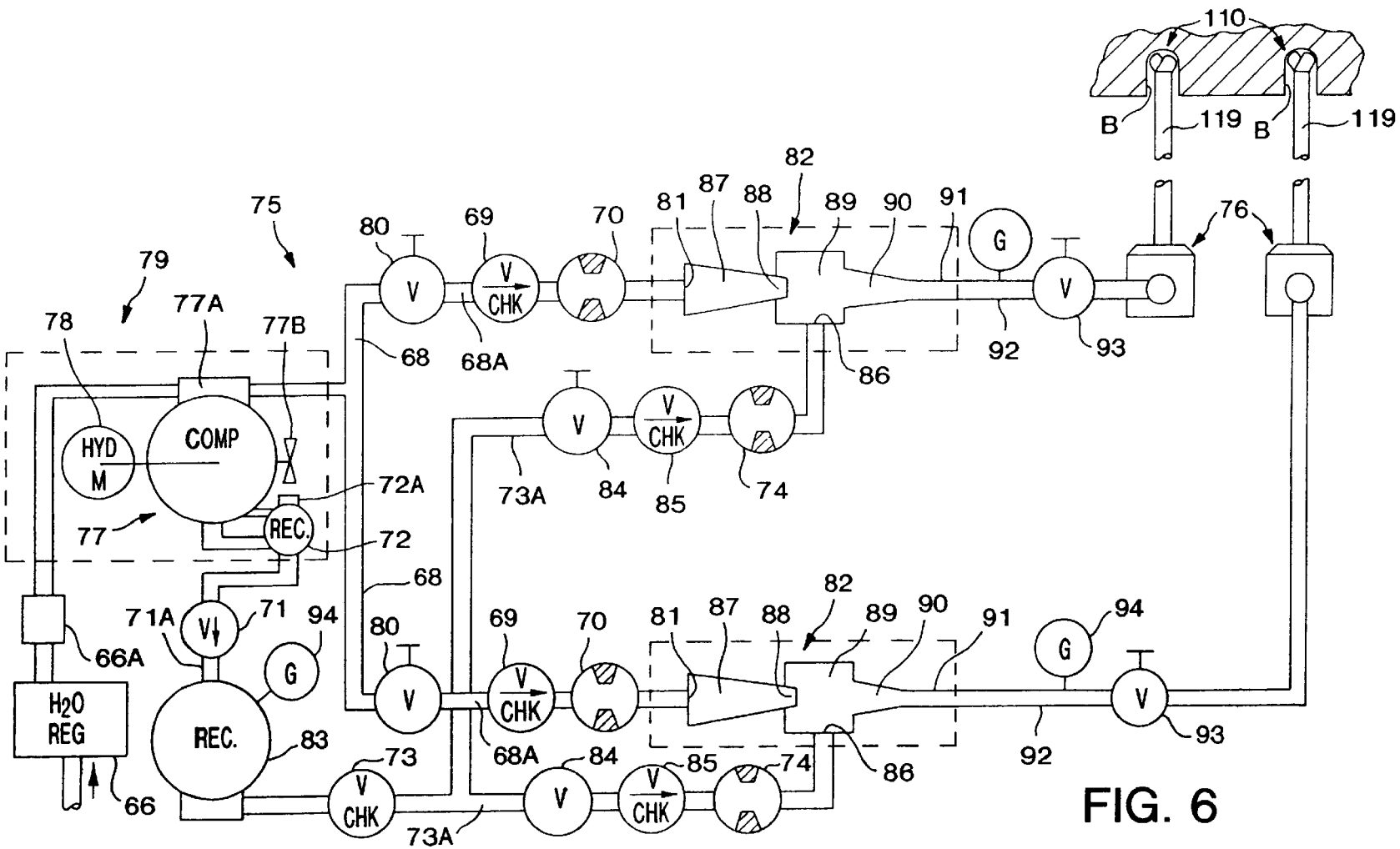
FIG. 6 is a diagrammatic view of an air-water drilling system to which the invention pertains.
Figure 16:
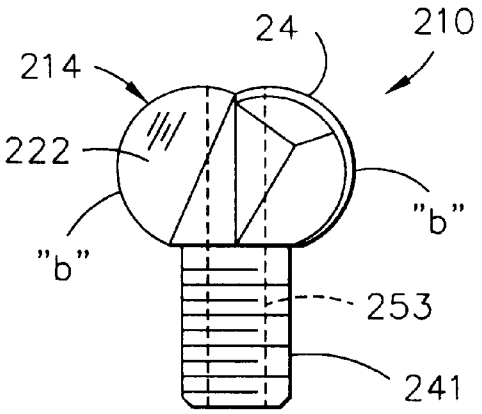

My parent application Ser. No. 08/689,667 teaches low volume air-water drilling systems and methods to provide efficient irrigation and drill bit cooling using minimal amounts of water and improving mine safety conditions. A preferred embodiment of such a drilling system is shown in FIG. 6 in which the drilling system 75 uses a double boom New Fletcher roof bolter machine having two machine drives 76 operating vertical long rod drive steel columns 119 to rotationally drive roof drill bits 110, or drill bits 10 (FIG. 1) or 210 (FIG. 16). As will be readily apparent, the drilling system 75 has a separate flushing fluid handling network for each drilling column 119, although a common air-water source may be employed for double boom machines as will now be briefly summarized.

The system 75 is designed to provide an air-water mist as the flushing fluid for use in roof drilling and other mining operations where the fluid is non-recoverable. A compressor-pump 77 receives a flow of water at about 100–120 psi through inlet line 67 from a water source, and this flow of water coolant to the compressor 77 preferably constitutes the water source for the air-water mist of the system 75. The water flows through the compressor to an adjustable water volume regulating valve 80 and thence is delivered through one-way check valve 69 and an orifice port 70 to the intake port 81 of an atomizing jet pump 82. The orifice restrictor 70 is important to control the flow of water in the internal manifold area 89 of the jet pump so the water does not cut off the air intake and prevent admixing in this chamber.

The air compressor 77 compresses ambient air and delivers it past check valve 71 to a compressed air receiver 73 and thence through a check valve 73 to an adjustable air volume regulating valve 84 providing a constant air output volume in the range of 12.0 to 22.0 cfm at a pressure of about 100 to 120 psi. Compressed ambient air is then delivered at a constant flow rate through another one-way check valve 85 and an orifice restrictor 74 to air intake port 86 of the jet pump 82. Thus, both water and air are delivered into the large mixing chamber 89 of the jet pump 82 at about 120 psi through the respective orifice restrictors 70 and 74 thereby creating a turbulent admixture thereof.

The jet pump 82 typically operates on the principal of one fluid being entrained into a second fluid. Thus, water flow through a restrictor chamber 87 to a venturi or nozzle 88 produces a high velocity water jet discharge into and across the large manifold chamber 89, which also receives the air flow from inlet port 86 substantially at right angles. The high velocity water and air streams flowing into and through the chamber 89 are entrained and the flow of pressurized ambient air into the water stream causes the water particles to convert to an air-water mist, which is then pushed or carried forwardly into a diffuser section 90 and out through discharge nozzle 91 connected to a fluid line 92 extending to the drive steel column 119 of the drilling machine 76.

It is of great importance when working with optimum low volumes of air or air-water mist that there be no air loss or leakage in the system that would create problems such as insufficient air to flush cuttings from the drill hole B resulting in plugged drill bits and build up of cuttings, slowed bit penetration and premature bit wear. Thus, my prior application Ser. No. 09/046,382 was directed to improvements in rotary drilling systems having a "no-leak" drill steel coupling and reamer means cooperatively constructed and arranged to deliver optimum drilling fluid flow and remove bore-hole cuttings, as shown and briefly described with reference to FIGS. 7–16.

Figure 7:
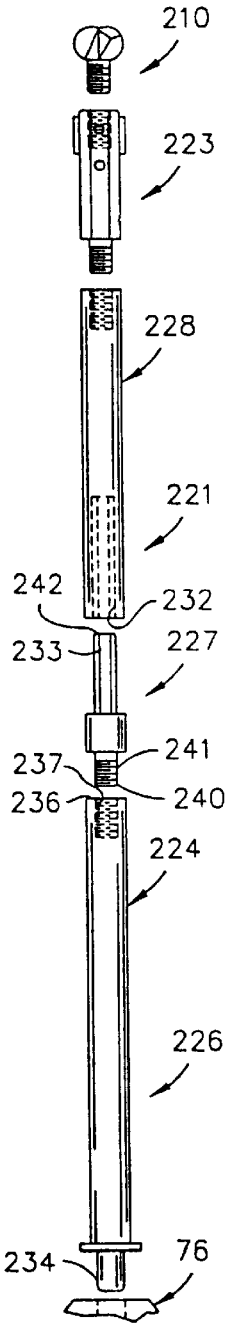
FIG. 7 is an exploded view of a drill steel column and coupling system to which the invention pertains.
Figure 8:
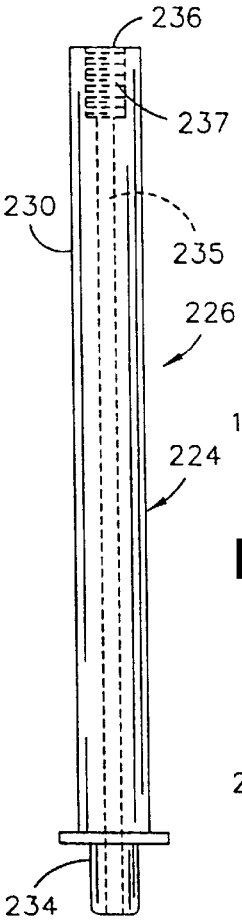
FIG. 8 is an enlarged elevational view of a drive steel member of the drive steel column.
Figure 11:
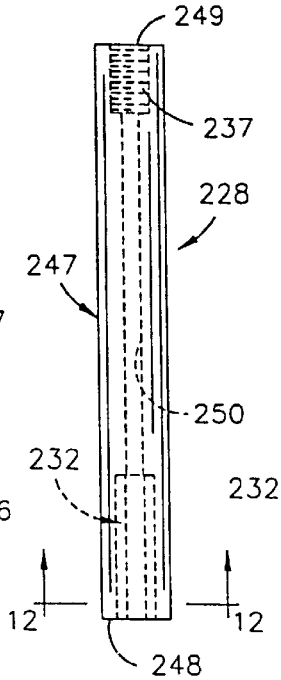
FIGS. 9–16 are views of a drive steel column and coupling system from my co-pending application Ser. No. 09/046,382.
Figure 12:
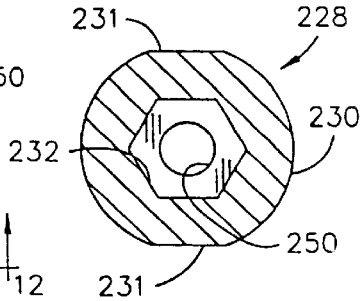
Figure 9:
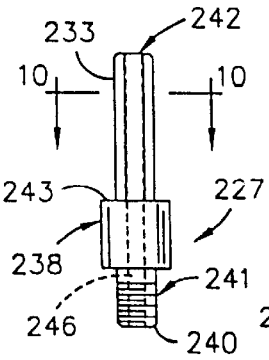
Figure 10:
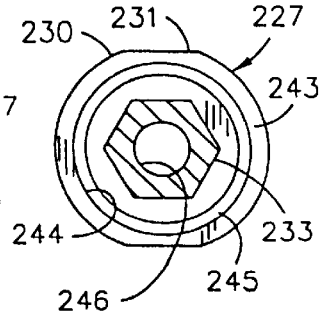
Figure 14:
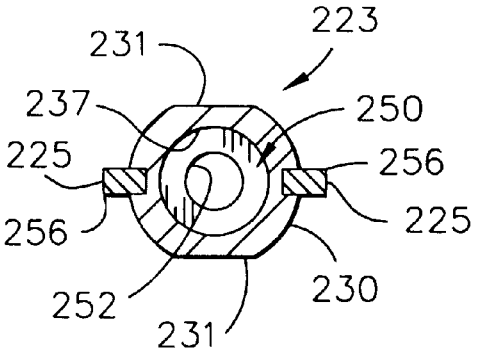

FIG. 7 shows a vertically oriented drill steel column and reamer coupler system 221 in exploded view and includes a drive steel starter member 226 (FIG. 8), a drive steel coupler member 227 (FIG. 9, 10), an extension member 228 (FIG. 11, 12) and a reamer bit seat or coupler member 223 (FIGS. 13–15) adapted to seat and couple drill bit 210 to the column 221. In this embodiment the drive steel column has a substantially circular outer wall 230 with opposed longitudinal or axially disposed flats 231 to provide tool-engaging surfaces for assembly and disassembly (FIGS. 10, 12 and 14). A principal feature of that invention was to facilitate such assembly or disassembly while maintaining substantially air tight, sealed joints between the column members during drilling operations, and my drive steel coupling system was developed to employ combinations of threaded ends and socket-type ends having multi-faced sides to provide a non-rotational slip-fit connection. In a preferred embodiment a hexagonal (hex) female end socket 232 on one drive steel or coupler member receives a mating hex male end plug 233 of the adjacent member.

The present invention relates to the chucking connection of the drive steel column 119, 221 or the like with the drilling machine (76) in order to further the sealed integrity of the fluid delivery system from the drilling machine to the drilling bit (10, 110, 210). Thus, the improvement of this invention relates to a fixed chuck shank adapter 311 on the drive end 334 of the lower or first drive steel starter member 226 (FIGS. 7, 8) which is constructed and arranged for driving connection in the conventional chuck sealing grommet means (not shown) of the drilling machine (76), as will be described more fully. Still referring to FIG. 8, the drive steel starter member 226 has an elongated body 224 shown to be of circular cross-section (230) with flats (231), and has an axial through-bore 235 as the fluid passageway from end to end. The upper second end 236 has an internally threaded female end socket 237. Although FIGS. 7–16 illustrate drive steel members with circular outer walls (230), the present invention will be disclosed in FIGS. 17–20 with reference to drill rods having a hexagonal (hex) outer surface 330 of a size range of ⅞" to 1⅛" (after first condensing the description of prior application Ser. No. 09/046,382 as incorporated in full herein by reference).

Figure 13:
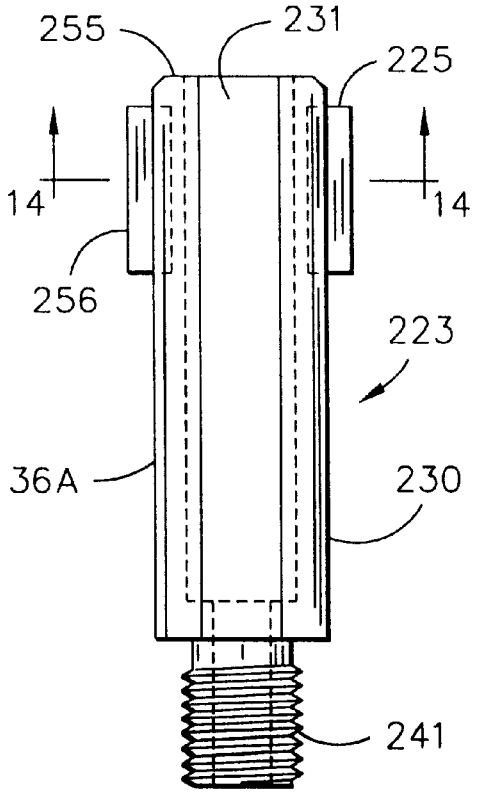
Figure 15:
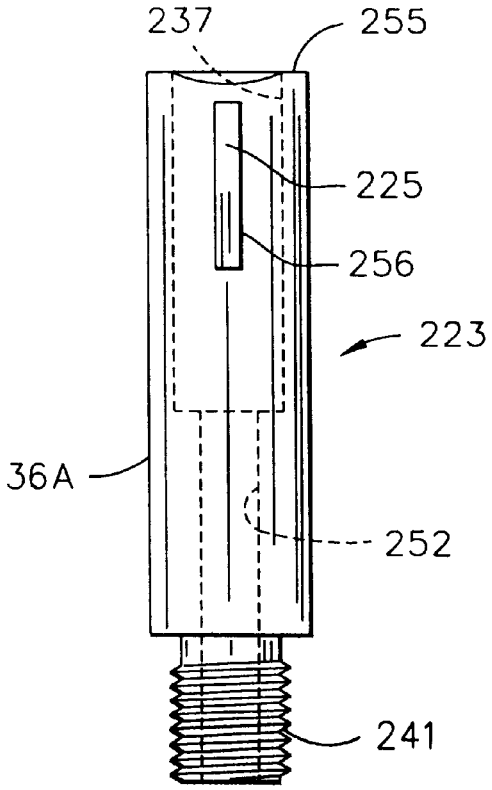

A typical drive steel column may require one or more middle extension drive steel members 228 so as to appropriately position the drill bit (210) for drilling engagement with the roof. FIGS. 9 and 10 show that the half-threaded/half hex connecting system of my earlier invention uses a relatively short drive steel coupler member 227 for mounting an extension member 228 on the starter member 226. The coupler member 227 is constructed and arranged with different coupler end means; an exteriorly threaded male end plug 241 on one end and a slip fit hexagonal outer wall 233 on the other end 242. Both ends having a mating sealing engagement with the ends 236, 248 of adjacent drive steel members 224, 228, and the coupler 227 has an axial through-bore 246. FIGS. 11 and 12 show one form of a middle extension member 228 joined in the column 221 by coupler 227; and FIGS. 13–15 show a reamer/bit coupler 223 connected to the drive steel column and constructed to threadedly receive a drill bit 210 (FIG. 16). The bit coupler 223 has a through-bore 252 for delivery of flushing fluid to the drill bit which is drilled and grooved or channeled in a typical manner for the flow of fluid to the cutting elements (222). My prior invention accommodated extended drilling operations with the drill bit by providing the reamer means (125, 225) on the bit coupler (123, 223), preferably arranged with pairs of elements 125, 225 on opposite outer sides of the bit coupler.

Figure 17:
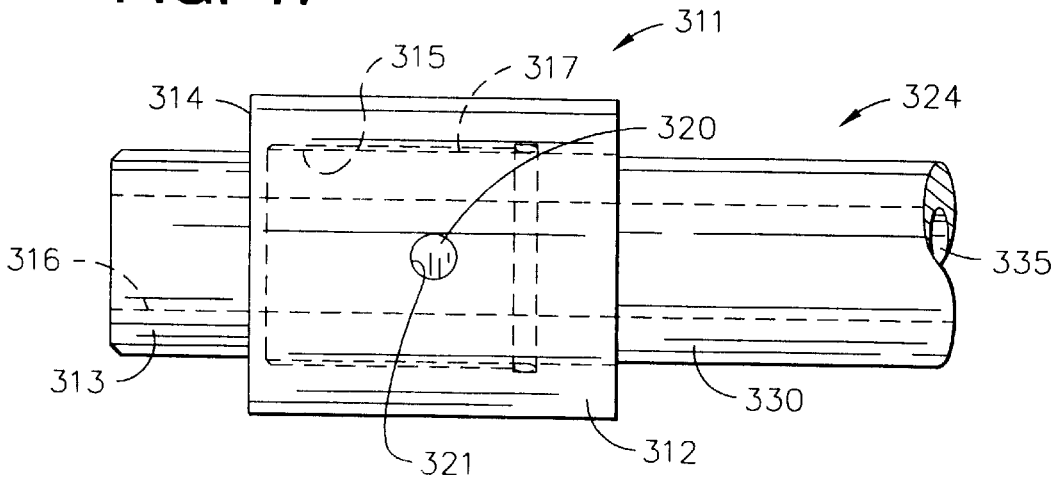
FIG. 17 is an enlarged elevational view of the chuck shank adapter of the invention as secured on a drill steel drive member.
Figure 18:
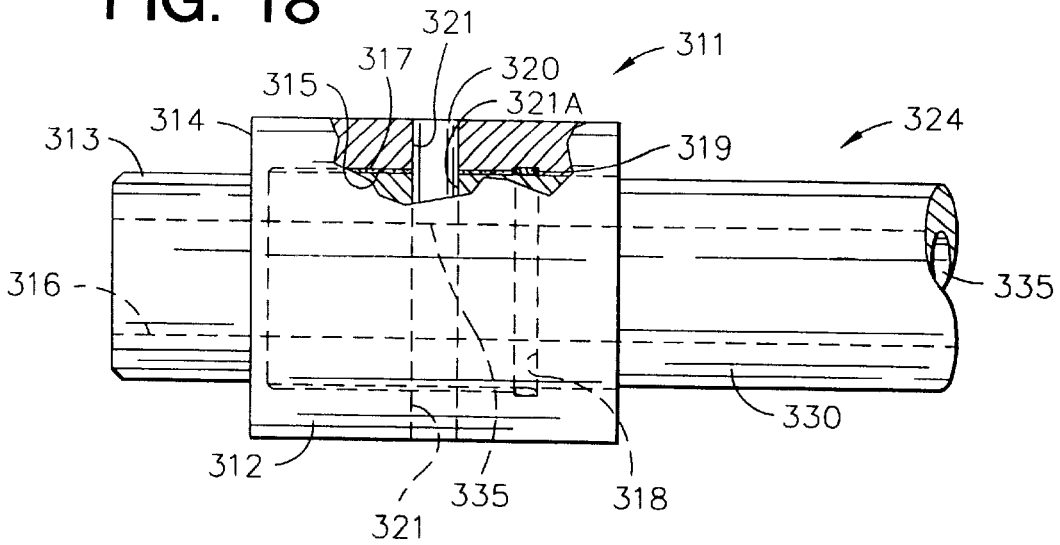
FIG. 18 is an elevational view as rotated 90° from FIG. 17; and broken away to show sealing means.

Referring now to FIGS. 17 and 18, in one form of the invention the chuck adapter 311 has a main body section 312 and a chuck seating section 313 projecting from the main body and forming an annular, radially-extending shoulder 314. The starter drill steel member 324 (FIG. 17) has an exterior hex body surface 330, and an axial through-bore 335 is formed from end to end. The main body 312 has an interior cavity or socket 315 with machined side walls complementary to the exterior wall 330 of the drive steel 324 so as to nestably receive the lower end 334 thereof with a sliding fit. The lower chuck seating section or shank 313 has a square or hex exterior surface constructed for a sealed driving connection in the chuck (not shown) of the drilling machine (76). The shank 313 is bored, at 316, to communicate with the main body socket 315 and, in assembly, with the through-bore 335 of the drill steel 324.

The chuck adapter 311 and drill steel 324 are assembled in sealed condition by applying a sealant, such as a silicon epoxy (317) to the outer lower end surface 334 of the drill rod or to the interior surface 315 of the main body cavity 315, or to both surfaces. The inner cavity wall 315 is further machined to form an annular groove or recess 318 for an O-ring seal 319. Wherefore, when assembled, the main body and drive steel 324 are double sealed against air/water leakage thereby ensuring the integrity of the fluid delivery system into and through the drive column. A secure locking relationship between these members 311 and 324 is further assured by mechanical locking means in the form of at least one cross pin 320 arranged in aligned bores 321, 321A through adapter 311 and drive steel 324 to extend transversely of the axial through-bore 335. Two short pins 320 are shown in FIGS. 17 and 18, the pins just extending substantially from the outer adapter wall 312 to the inner fluid passageway 335 on each side so as not to impede fluid flow in the passageway. This is the preferred arrangement for dry drilling, i.e. when the fluid is air/vacuum. When drilling wet, a single long diametral pin (320) may be used across the entire main body member 312. In either case, the exterior pin end is preferably welded to the main body wall.

Figure 19:
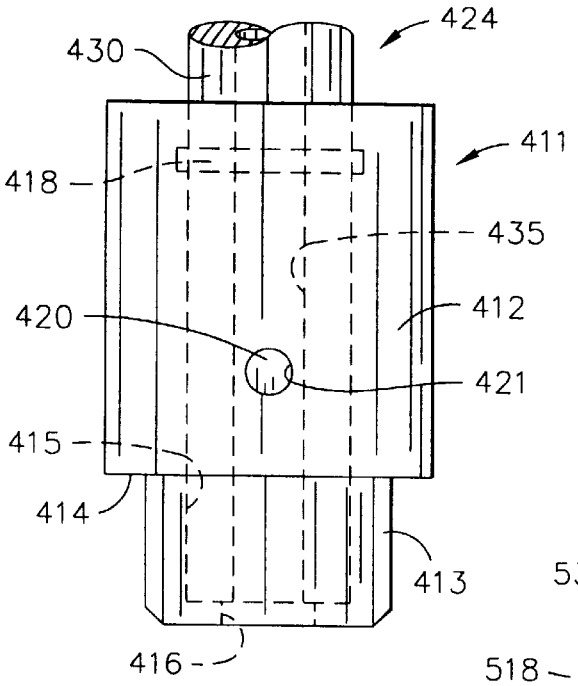
FIG. 19 is an elevational view of a modified chuck adapter.

Referring to FIG. 19, a modified chuck seat adapter 411 is illustrated in which the body cavity 415 is extended into the lower shank section 413 thereby providing a longer side wall bearing surface between the drill steel lower end 434 and the adapter 411. The bore 416 is relatively short, and preferably has a larger diameter than the axial through-bore in the drill steel member 424.

Figure 20:
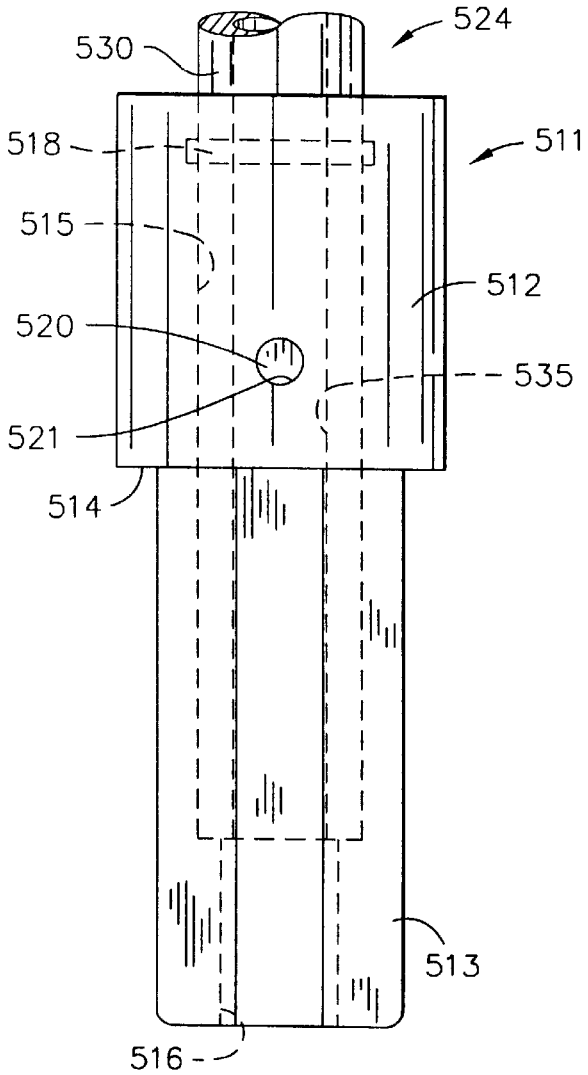
FIG. 20 is an elevational view of another drill steel shank.

Similarly, with reference to FIG. 20, an even longer chuck adapter member 511 has a main body section 512 and a greatly extended chuck shank section 513. The machined socket 515 extends a major length into this shank section 513 from the body section. Again, the fluid bore 516 from the seating end of the shank to the cavity has a greater diameter than the drive steel through-bore; and it may be tapered to provide a wedging fit with the typical frusto-conical chuck seat (not shown) of the drilling machine.

The assembly of the chuck adapter 311, 411, 511 on the starter drive steel 324, 424, 524 will be apparent from the foregoing description. An O-ring 319 (419, 519) is positioned in the adapter groove 318 (418, 518) and at least one of the mating surfaces between these members is coated with an epoxy sealant 317. The members are then telescoped into a nested condition and the cross-pin(s) 320, 420, 520 is inserted in bores 321, 321A (421, 521) cross-wise of the axis and the ends are welded to rigidly lock the two members in fixed relationship.

In operation, the drill steel column 221 (FIG. 7) is assembled on the drilling machine with the appropriate threaded and hex socket connections between the respective members and couplers to position the drill bit (10, 110, 210) at the location to be drilled. Although drilling rotational speeds may be varied, the drive column and drill bit are always under compression to assure tight sealing between members so that drilling fluids are delivered to the drill bit head with no appreciable loss or pressure drop. The chuck seating adapter 311 of the present invention is important to assure that no pressure loss occurs at the initial lower end of the column, particularly with my low air-water misting system. As the drilling progresses, the drill bit head 14, 214 will continue to drill into the wall structure and the resulting cuttings should be flushed outwardly by the drilling fluids to clean the bore-hole B which, of course, is easier in roof boring than in side wall operations and obviously easier with higher volumes of drilling fluids. In my preferred system - which employs half threaded and half hex coupling combinations and low volumes of air and water in addition to my new chuck adapter—it is imperative that there are no leaks in the system or the problems of premature bit wear, plugged drill bits, slow penetration and the like will result because of insufficient flushing action.

It is now apparent that the objects and advantages of the present invention have been met. Changes and modifications of the disclosed forms of the invention will become apparent to those skilled in the mining tool art, and the invention is only to be limited by the scope of the appended claims.

What is claimed is:

1. In combination with a drive steel member adapted for releasable connection with a drilling machine chuck of a rotary drilling system, and which drive steel member is internally ported for the passage of drilling fluids; the improvement of chuck shank means constructed and arranged to form a permanent chuck adapter on one end of the drive steel member, said chuck adapter comprising a main body section and an internally ported chuck seating section, internal means in said main body section sealably receiving said one drive steel member end, and fastening means for rigidly securing said drive steel member within said main body section.

2. The combination of claim 1, in which said main body opening extends axially into the chuck seating section whereby to provide an optimum wall surface contact of said one end of the drive steel member with the chuck adapter.

3. The combination of claim 1, in which said fastening means comprises an epoxy-type substance.

4. The combination of claim 3, in which said epoxy-type substance is applied to at least one wall of the main body opening or the drive steel member.

5. The combination of claim 1, in which the fastening means comprises pinning means connecting the walls of the main body section and the drive steel member.

6. The combination of claim 1, in which the internal porting of said drive steel member comprises an axial through-bore in fixed communication with the internal porting of said chuck seating section to accommodate drilling fluid flow therein.

7. The combination of claim 6, in which said walls of the main body section and drive steel member have cross bore means extending transversely of the axial through-bore, and said fastening means comprise pinning means in said cross bore.

8. The combination of claim 7, in which said pinning means extends diametrally of said main body section and drive steel member and is sealably secured in place.

9. The combination of claim 8, in which the drill steel member is prepared for use with a wet drilling fluid, and the pinning means comprises a long pin member extending through the main body section and drive steel member.

10. The combination of claim 8, in which the drill steel member is prepared for use with a dry drilling fluid, and the pinning means comprises a pair of short pin members arranged in aligned cross bore openings in the walls on opposite sides of the axial through-bore.

11. The combination of claim 6, including double sealing means constructed and arranged for sealing the through-bore against drilling fluid leakage from the chuck shank means.

12. The combination of claim 11, in which one of said sealing means comprises an annular seal arranged between the mating wall surfaces of the chuck adapter main body section and drive steel member.

13. The combination of claim 11, in which one of said sealing means comprises an epoxy-type substance applied to at least one of the mating wall surfaces of the chuck adapter main body section and drive steel member.

14. The combination of claim 3, in which said epoxy-type means also acts as fluid sealing means between said main body section and said drive steel member.

15. A rotary drilling system comprising a sectional drive steel column for connecting a drilling machine and a rotary drill bit for cutting bores, comprising a drive steel member with a multi-faced outer wall surface and an internal fluid passageway, a chuck adapter member having a multi-faced female socket complementary to the outer wall surface of said drive steel member, said chuck adapter member having an internal fluid passageway, said drive steel and chuck adapter members having multiple fastening and sealing means constructed and arranged to accommodate, in use, the internal flow of drilling fluid into and through said internal passageways without substantial pressure loss.

16. The drilling system of claim 15, in which said multi-faced outer wall surface of said drive steel member is hexagonal.

17. The drilling system of claim 15, in which said chuck adapter member includes a main body section and a chuck shank section having a multi-faced outer wall adapted for seating engagement in the drilling machine chuck.

18. The drilling system of claim 17 in which the multi-faced wall of said chuck shank section is hexagonal or square.

* * * * *